US010085088B2

(12) United States Patent
Rocca et al.

(10) Patent No.: US 10,085,088 B2
(45) Date of Patent: Sep. 25, 2018

(54) ELECTRONIC CIRCUIT FOR A MICROPHONE AND METHOD OF OPERATING A MICROPHONE

(71) Applicant: EPCOS AG, Munich (DE)

(72) Inventors: Gino Rocca, Copenhagen (DK); Pirmin Hermann Otto Rombach, Kongens Lyngby (DK)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 15/316,460

(22) PCT Filed: Jun. 5, 2014

(86) PCT No.: PCT/EP2014/061726
§ 371 (c)(1),
(2) Date: Dec. 5, 2016

(87) PCT Pub. No.: WO2015/185144
PCT Pub. Date: Dec. 10, 2015

(65) Prior Publication Data

US 2017/0164105 A1 Jun. 8, 2017

(51) Int. Cl.

| | |
|---|---|
| ***H04R 3/00*** | (2006.01) |
| ***H04R 1/04*** | (2006.01) |
| ***H04R 19/00*** | (2006.01) |
| ***H04R 19/04*** | (2006.01) |

(52) U.S. Cl.
CPC ..... *H04R 3/00* (2013.01); *H04R 1/04* (2013.01); *H04R 19/005* (2013.01); *H04R 19/04* (2013.01)

(58) Field of Classification Search
USPC ..... 381/26, 55, 57, 91, 92, 111, 113, 355
See application file for complete search history.

(56) References Cited

U.S. PATENT DOCUMENTS

| | | | | |
|---|---|---|---|---|
| 5,732,143 | A * | 3/1998 | Andrea | G10K 11/178 381/71.13 |
| 8,265,306 | B2 * | 9/2012 | Frey | H04R 3/00 381/111 |
| 8,600,088 | B2 * | 12/2013 | Rasmussen | H04R 25/43 381/23.1 |
| 2009/0003629 | A1 * | 1/2009 | Shajaan | H04R 1/005 381/113 |
| 2010/0195838 | A1 * | 8/2010 | Bright | H04M 1/03 381/57 |

FOREIGN PATENT DOCUMENTS

| | | | |
|---|---|---|---|
| CN | 202384000 | U | 8/2012 |
| JP | 2012025270 | A | 2/2012 |
| WO | 2005039041 | A1 | 4/2005 |

* cited by examiner

*Primary Examiner* — Yosef K Laekemariam
(74) *Attorney, Agent, or Firm* — Slater Matsil, LLP

(57) ABSTRACT

An electronic circuit for a microphone comprises a first terminal and a second terminal, wherein the electronic circuit is selectively operable in a first mode and a second mode. In the first mode, the first terminal is configured for microphone output and in the second mode, the second terminal is configured for microphone output. Furthermore, a method of operating a microphone is provided.

15 Claims, 1 Drawing Sheet

ELECTRONIC CIRCUIT FOR A MICROPHONE AND METHOD OF OPERATING A MICROPHONE

This patent application is a national phase filing under section 371 of PCT/EP2014/061726, filed Jun. 5, 2014, which is incorporated herein by reference in its entirety.

TECHNICAL FIELD

The present disclosure relates to an electronic circuit for a microphone. In particular, the electronic circuit may be configured as an ASIC (application-specific integrated circuit). Furthermore, the present disclosure relates to a microphone comprising the electronic circuit. The microphone may be fabricated in MEMS technology (micro-electrical-mechanical systems). Furthermore, a method of operating the microphone is disclosed.

BACKGROUND

For various applications, microphones may be operated in a three-terminal mode. In the tree-terminal mode, separate terminals for power, ground and output may be provided. For other applications, a two-terminal mode may be required. In the two-terminal mode, power and output may be allocated to the same terminal.

SUMMARY OF THE INVENTION

Embodiments of the invention provide an electronic circuit and a microphone with improved properties. In particular, various embodiments enable an operation of an electronic circuit in different modes. Furthermore, various other embodiments provide an improved method of operating a microphone.

One aspect of the present disclosure relates to an electronic circuit for a microphone. The electronic circuit may be configured as an ASIC. The electronic circuit comprises a first terminal. The first terminal may be configured for power supply. The power may be supplied to components of the electronic circuit, such as a transistor. Additionally or alternatively, the power may be supplied for operating a transducer connectable to the electronic circuit.

The electronic circuit comprises a second terminal. The function of the second terminal may depend on a selected mode of the electronic circuit.

The electronic circuit may comprise a third terminal. The third terminal may be configured for ground.

In an embodiment, the electronic circuit may be operable in a first mode. In the first mode, the second terminal is not configured for microphone output. Instead, the second terminal may be connected to ground. A capacitor may be provided to connect the second terminal capacitive to ground. Additionally, electromagnetic interference (EMI) protection may be provided by the capacitor. The microphone output may be provided at the first terminal. Accordingly, in the first mode, the first terminal may be configured both for power supply and microphone output. The third terminal may be configured for ground. The first mode may also be referred to as a two-terminal mode, because power supply, microphone output and ground may be allocated to two terminals.

In an embodiment, the electronic circuit may be operable in a second mode. The second mode may be a three-terminal mode. In the second mode, the second terminal is configured for microphone output. Accordingly, an electric output signal may be provided at the second terminal. In the three-terminal mode, the first terminal may only be configured for power supply. The second mode may also be referred to as a three-terminal mode, because power supply, microphone output and ground may be allocated to three terminals.

The electronic circuit may be selectively operable in the first mode and in the second mode. For this aim, the electronic circuit may be programmable to work in the first or in the second mode.

The electronic circuit may comprise a memory. The memory may be a non-volatile memory. The memory may be configured for setting the electronic circuit in the first or second mode. In particular, the memory may be programmable for selecting one of the modes. Furthermore, the memory may be configured for enabling a tuning of the sensitivity of the microphone.

The electronic circuit may comprise an adjustable load. In particular, the electronic circuit may comprise at least one switchable resistor. The switchable resistor may be controlled by the memory. In particular, the memory may switch the resistor on or off. In this context, "switchable" means that the amount of current flowing through the resistor can be controlled, in particular by opening or closing a switch. "Switching off" or "inactivating" the resistor may mean that a small current is enabled to flow through the resistor. "Switching on" or "activating" the resistor may mean that a larger current is enabled to flow through the resistor. The switchable resistor allows adjusting the sensitivity of the electronic circuit resp. of the microphone to the target. By switching the resistors on or off, the same electronic circuit may be used in the first and second mode. In an embodiment, the switchable resistor is switched on in the first mode. The switchable resistor may be switched off in the second mode.

The operation of the electronic circuit in the first mode may not require additional external resistors. Preferably, the electronic circuit is configured as an ASIC, the switchable resistor being integrated in the ASIC. This allows reducing the required space of the electronic circuit. The integrated resistors may only add little to the area. Furthermore, by integrating the resistor in the electronic circuit, in particular the ASIC, the sensitivity variation of the microphone may be reduced. A sensitivity variation may arise due to tolerances of external components.

The electronic circuit may comprise at least one switch. The switch may be used to activate or inactivate the switchable resistor. In particular, the switch may be controllable by the memory. Depending on the programmed mode, the memory may open or close the switch. Thereby, the switchable resistor may be activated or inactivated. In an embodiment, the switch is closed in the first mode. The switch may be open in the second mode.

In an embodiment, a switch may be connected in series to the switchable resistor. For activating the resistor, the switch may be closed. For inactivating the resistor, the switch may be opened. The switch may be closed in the first mode and open in the second mode.

As a further example, a switch may be connected in parallel to a resistor. For activating the resistor, the switch may be opened. For inactivating the resistor, the switch may be closed. The switch may be open in the first mode and closed in the second mode.

The electronic circuit may comprise a signal input for receiving a signal from a transducer. In an embodiment, a switchable resistor is located in an electric path between the signal input and the second terminal. The switchable resistor may be connected in parallel to a further resistor.

In an embodiment, a switchable resistor may be located in an electric path between the signal input and the third terminal. A switch may be connected in parallel to the resistor.

In an embodiment, the electronic circuit comprises two switchable resistors. The electronic circuit may comprise two switches, each of the switches being allocated to one of the resistors. In particular, the electronic circuit may comprise a first switchable resistor connected to the third terminal and a second switchable resistor connected to the second terminal, for example, as described above.

In an embodiment, the at least one switchable resistor is tunable. Preferably, the memory controls a tuning of the resistor. The tuning may enable adjusting the sensitivity of the microphone. This allows setting the resistor to the value that will result in the sensitivity required by the customer in the two-terminal mode. Thereby, a spread in the sensitivity, which may arise not only due to the resistor but also due to the spread of the microphone sensitivity, may be reduced. Furthermore, a tuning may also allow adjusting the current consumption and the THD (total harmonic distortion) performance of the microphone. In particular, the memory may enable a fine-tuning of the resistor.

A further aspect of the present disclosure relates to a microphone comprising an electronic circuit and a transducer. The electronic circuit may comprise any structural and functional features as described above. Features described with respect to the microphone are also disclosed herein with respect to the electronic circuit and vice versa, even if the respective feature is not explicitly mentioned in the context of the specific aspect.

The transducer may by manufactured by application of MEMS technology. The transducer may comprise a capacitor. In particular, an acoustical input signal may result in a change of capacitance of the transducer. Accordingly, the microphone may be a condenser or capacitor microphone. The transducer may comprise a diaphragm and one or more back-plates. In particular, the transducer may be a single-ended or differential transducer.

According to a further aspect of the present disclosure, a method of operating a microphone is provided. The method may comprise any functional and structural characteristics of the microphone as described above. Features described with respect to the microphone are also disclosed herein with respect to the method and vice versa, even if the respective feature is not explicitly mentioned in the context of the specific aspect.

The method comprises the step of selecting one of the modes. In particular, selecting the modes may mean programming the memory to operate in the first or second mode. Furthermore, the method comprises the step of operating the microphone in the selected mode.

The method may also comprise the step of tuning the at least one switchable resistor. As an example, a fine tuning of the resistor may be carried out. For fine tuning the resistor, the microphone may be operated in the selected mode. Then, a parameter of the microphone may be determined, for example, by measurement on the microphone output. As an example, the sensitivity, the THD performance or the current consumption may be determined. After that, the values of the resistors may be adjusted by programming the memory. This allows optimizing the parameters of the microphone.

BRIEF DESCRIPTION OF THE DRAWINGS

Further features, refinements and expediencies become apparent from the following description of the exemplary embodiments in connection with the figures.

Similar elements, elements of the same kind and identically acting elements may be provided with the same reference numerals in the figures.

DETAILED DESCRIPTION OF ILLUSTRATIVE EMBODIMENTS

Figure 1:
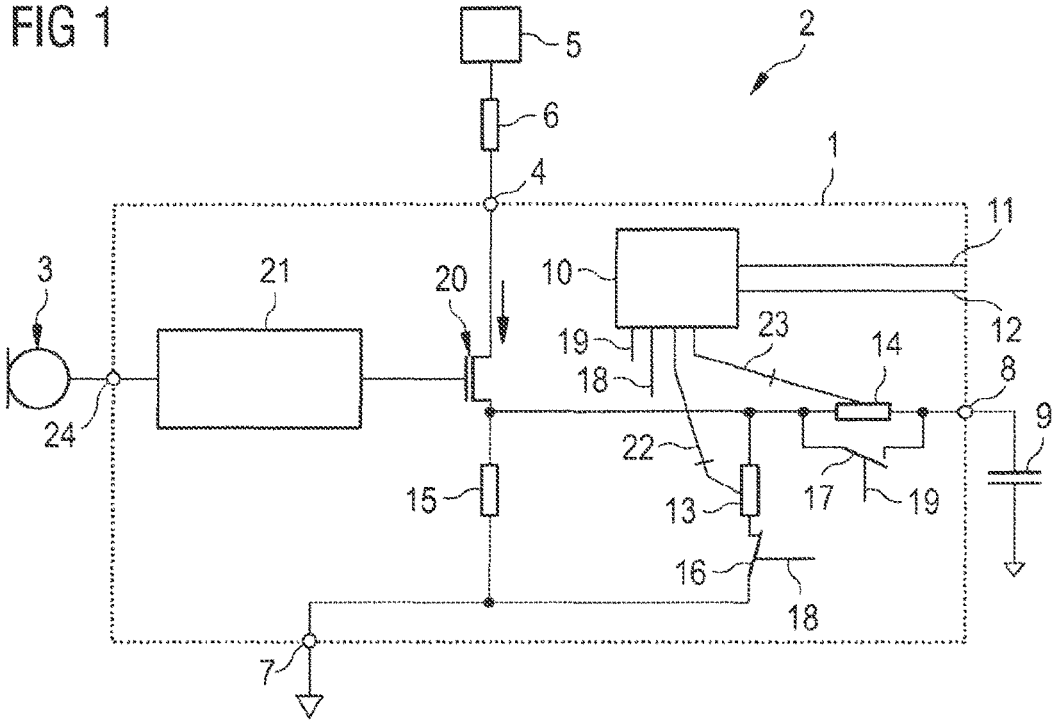
FIG. 1 shows a schematic diagram of an electronic circuit 1 for a microphone 2 in a first mode.
Figure 2:
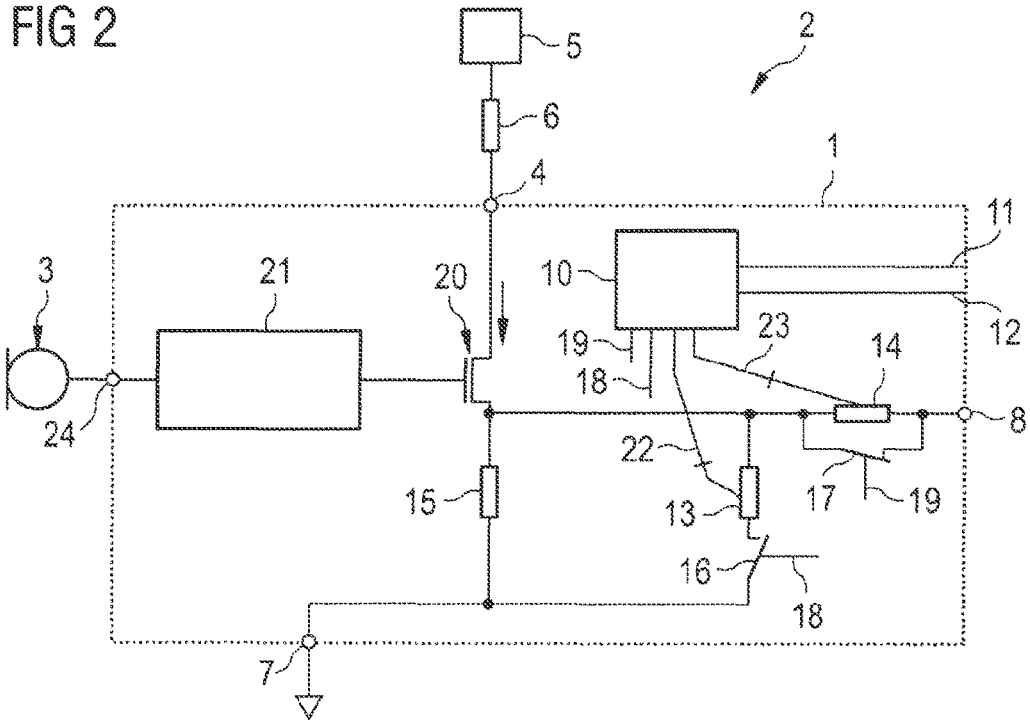
FIG. 2 shows a schematic diagram of an electronic circuit 1 for a microphone 2 in a second mode.

FIGS. 1 and 2 show an electronic circuit 1 for a microphone in two different modes. In FIG. 1 the electronic circuit 1 is in the first mode and in FIG. 2 the electronic circuit 1 is in the second mode.

The electronic circuit 1 is an application-specific electronic circuit (ASIC). The electronic circuit 1 may be fabricated as a die.

The microphone 2 may comprise a transducer 3, in particular a MEMS transducer, for converting an acoustical input signal into an electrical signal. As an example, the transducer 3 may comprise a semiconductor material such as silicon or gallium arsenide. The transducer 3 may comprise a diaphragm and one or more back-plates. As an example, the distance between the diaphragm and a back-plate may be in a range of 1 μm to 10 μm. The transducer 3 may be configured as a differential transducer or as a single-ended transducer, for example.

The microphone 2 may comprise a MEMS die and an ASIC die comprising the electronic circuit 1. The shown electronic circuit 1 may also be used with other transducers than a MEMS transducer. The microphone 2 may be used in a headset, for example.

The transducer 3 is electrically connected to the electronic circuit 1. In particular, the electronic circuit 1 may process a signal of the transducer 3. As an example, the signal may be processed by a transistor 20, which may function as an amplifier, and/or by further parts 21. Furthermore, the electronic circuit may provide the transducer 3 with a bias voltage, which is not shown in detail in the figure.

The electronic circuit 1 comprises a first terminal 4 for connecting the electronic circuit 1 to a voltage supply 5. A resistor 6 may be located in the connection between the first terminal 4 and the voltage supply 5. The resistor 6 is connected in series to the voltage supply 5.

The electronic circuit 1 comprises a third terminal 7 for connecting the electronic circuit 1 to ground. The transducer 3 may also be connected to ground.

The electronic circuit 1 comprises a second terminal 8, which may have a function depending on an operation mode of the electronic circuit 1. The terminals 4, 7, 8 may be configured as pins.

As shown in FIG. 1, the electronic circuit 1 may be operable in a first mode, which may be a two-terminal mode. In the first mode, the second terminal 8 may not be used as a microphone output. Instead, in the first mode, the second terminal 8 may be connected to ground via a capacitor 9. The capacitor 9 may be connected in series to the second terminal 8. The capacitor 9 may not be part of the electronic circuit 1, in particular not part of the ASIC.

As shown in FIG. 2, the electronic circuit 1 may also be operable in a second mode, which may be a three-terminal mode. In the second mode, the second terminal 8 may be used as a microphone output. A capacitor may not be connected to the second terminal 8. An electrical signal generated by the transducer 3 in response to an acoustical input may be provided at the second terminal 8.

As can be seen in FIGS. 1 and 2, the electronic circuit 1 comprises a memory 10 for enabling an operation in the first or second mode. The memory 10 may be a non-volatile memory. The memory 10 comprises a control input 11 and a clock input 12. The memory is programmable by accessing the control input 11 from the outside, in particular via a control pin. Depending on the input signal provided to the control input 11, the memory 10 switches the electronic circuit 1 to work in a first or second mode.

The electronic circuit 1 comprises a first switchable resistor 13 and a second switchable resistor 14. The first switchable resistor 13 is connected to the third terminal 7. In particular, the first switchable resistor 13 is connected in series to the third terminal 7. A further resistor 15 is connected in parallel to the first switchable resistor 13. The first switchable resistor 13 can be activated and deactivated by a first switch 16. In the second mode, the first switch 16 is open such that the first switchable resistor 13 is inactive.

The second switchable resistor 14 is connected to the second terminal 8. The second switchable resistor 14 can be activated and deactivated by a second switch 17. The second switch 17 is connected in parallel to the second switchable resistor 14. In the second mode, the second switch 17 is closed such that the second switchable resistor 14 is bridged and, thus, inactivate.

The first and second switches 16, 17 are controlled by the memory 10. In particular, the memory 10 comprises a first switch control 18 controlling the status of the first switch 16 and a second switch control 19 controlling the status of the second switch 17. When the electronic circuit 1 is to be operated in the first mode the memory 10 closes the first switch 16 by providing a corresponding signal via the first switch control 18. Furthermore, the memory 10 opens the second switch 17 by providing a corresponding signal via the second switch control 19. By activating the first and second switchable resistors 13, 14, the sensitivity required in the first mode may be achieved.

When the electronic circuit 1 is switched to the second mode, the memory 10 opens the first switch 16 and closes the second switch 17. Thereby, the first and second switchable resistors 13, 14 can be deactivated.

Furthermore, the switchable resistors 13, 14 are tunable by the memory 10. In particular, the memory 10 comprises a first tuning control 22 and a second tuning control 23 for tuning the first resp. the second switchable resistors 13, 14. This allows a fine tuning of the switchable resistors 13, 14.

Thereby, the spread of the sensitivity in the first mode may be reduced. This spread may arise not only from the resistors but also from the overall spread of the microphone sensitivity. Thus, the total spread can be reduced. In particular, a sensitivity adjustment can be achieved by tuning the second switchable resistor 14. Furthermore, also the current consumption and the THD performance of the microphone may be adjusted, in particular by tuning the first switchable resistor 13.

The invention claimed is:

1. An electronic circuit for processing a signal of a transducer microphone and for providing a processed output signal, the electric circuit comprising:

a first terminal; and a second terminal, wherein the electronic circuit is selectively operable in a first mode and a second mode, wherein, in the first mode, the first terminal is configured for providing the processed output signal of the transducer microphone;

wherein, in the second mode, the second terminal is configured for providing the processed output signal of the transducer microphone;

wherein, in the first and second modes, the first terminal is configured for power supply; wherein the first mode is a two-terminal mode wherein power and output of the electronic circuit are provided at a single terminal and ground is provided at a further terminal; and wherein the second mode is a three-terminal mode wherein separate terminals are provided for each of power, ground and output.

2. The electronic circuit of claim 1, further comprising a memory for setting the electronic circuit in the first or second mode.

3. The electronic circuit of claim 1, further comprising at least one switchable resistor.

4. The electronic circuit of claim 3, wherein, in the first mode, the switchable resistor is switched on.

5. The electronic circuit of claim 3, further comprising a signal input for receiving a signal from a transducer, wherein the switchable resistor is located in an electric path between the signal input and the second terminal.

6. The electronic circuit of claim 1, further comprising a third terminal configured for ground.

7. The electronic circuit of claim 6, further comprising a signal input for receiving a signal from a transducer, wherein a switchable resistor is located in an electric path between the signal input and the third terminal.

8. The electronic circuit of claim 2, further comprising at least one switch controllable by the memory for switching on a switchable resistor.

9. The electronic circuit of claim 3, wherein the switchable resistor is tunable.

10. The electronic circuit of claim 9, wherein a memory controls a tuning of the switchable resistor.

11. The electronic circuit of claim 1, wherein the electronic circuit is an application-specific-integrated circuit (ASIC).

12. A microphone comprising:

a transducer; and an electronic circuit for processing a signal of the microphone and for providing a processed output signal, the electric circuit comprising a first terminal and a second terminal;

wherein the electronic circuit is selectively operable in a first mode and a second mode;

wherein, in the first mode, the first terminal is configured for providing the processed output signal of the transducer microphone;

wherein, in the second mode, the second terminal is configured for providing the processed output signal of the transducer microphone;

wherein, in the first and second modes, the first terminal is configured for power supply;

wherein the first mode is a two-terminal mode wherein power and output of the electronic circuit are provided at a single terminal and ground is provided at a further terminal; and wherein the second mode is a three-terminal mode wherein separate terminals are provided for each of power, ground and output.

13. The microphone of claim 12, wherein the transducer is fabricated in MEMS (Micro-Electrical-Mechanical Systems) technology.

14. A method for operating the microphone of claim 12, the method comprising:

selecting the first or second mode; and operating the microphone in the selected mode.

15. The electronic circuit of claim 1, further comprising an amplifier for amplifying a signal of the transducer microphone, wherein processing the signal includes an amplification of the signal.

* * * * *